US011006743B2

(12) United States Patent
Guerrero

(10) Patent No.: US 11,006,743 B2
(45) Date of Patent: May 18, 2021

(54) PROTECTIVE MAKEUP BRUSH CLEANSING KIT

(71) Applicant: Sheila Marie Guerrero, Memphis, TN (US)

(72) Inventor: Sheila Marie Guerrero, Memphis, TN (US)

( * ) Notice: Subject to any disclaimer, the term of this patent is extended or adjusted under 35 U.S.C. 154(b) by 131 days.

(21) Appl. No.: 16/501,109

(22) Filed: Mar. 22, 2019

(65) Prior Publication Data

US 2020/0297107 A1 Sep. 24, 2020

(51) Int. Cl.

| | |
|---|---|
| ***A46B 17/06*** | (2006.01) |
| ***A46B 17/04*** | (2006.01) |
| ***A46B 15/00*** | (2006.01) |
| ***A46B 17/00*** | (2006.01) |

(52) U.S. Cl.

CPC ..... *A46B 17/06* (2013.01); *A46B 15/0093* (2013.01); *A46B 15/0095* (2013.01); *A46B 15/0097* (2013.01); *A46B 17/00* (2013.01); *A46B 17/04* (2013.01)

(58) Field of Classification Search

CPC ..... A46B 15/0091; A46B 15/0093; A46B 15/0095; A46B 15/0097; A46B 17/00; A46B 17/04; A46B 17/06; A46B 17/065; A46B 17/08

USPC ..... 15/142, 184, 257.01; 132/312–314, 317, 132/318; 206/209, 209.1, 361, 362, 206/362.1, 362.2, 362.3, 15.2, 15.3; 211/65, 66

See application file for complete search history.

(56) References Cited

U.S. PATENT DOCUMENTS

| | | | | |
|---|---|---|---|---|
| 4,401,215 | A * | 8/1983 | Kramer | A46B 17/04 206/362.3 |
| 2013/0118937 | A1* | 5/2013 | Gelfand | A47K 1/09 206/362.1 |
| 2014/0332642 | A1* | 11/2014 | Lim | A46B 17/04 248/111 |

FOREIGN PATENT DOCUMENTS

| | | |
|---|---|---|
| FR | 2718927 | * 10/1995 |
| FR | 2921812 | * 4/2009 |
| GB | 2116028 | * 9/1983 |
| GB | 2261812 | * 6/1993 |

* cited by examiner

*Primary Examiner* — Mark Spisich

(57) ABSTRACT

A Protective Makeup Brush Cleansing Kit, including elements of the user and/or soap and water is provided. The Protective Makeup Brush Cleansing Kit will clean makeup brush bristles and protect makeup brush bristles by keeping them covered and free from pollutants. The Protective Makeup Brush Cleansing Kit covers will also prevent the makeup brush bristles from being bent and warp which increases longevity.

1 Claim, 8 Drawing Sheets

PROTECTIVE MAKEUP BRUSH CLEANSING KIT

FIELD

The present application relates to cleaning makeup brushes, in particular with cleaning, protecting and storage.

BACKGROUND

Makeup brushes are products that sometimes are used and handled roughly and therefore are exposed to being distorted, brittle and un-sanitized which could result in skin irritations and blemishes. The materials used for the makeup brushes are typically made of polyester and nylon and do not have a high longevity life. The recent trends towards preserving makeup brushes causes the makeup brush bristles to become distorted, warped and broken. In particular, the makeup brushes become bent and crushed when the makeup brushes are stuffed in makeup cases, purses and/or suitcases. Makeup brushes that are warped, brittle and distorted will not allow the makeup application to be applied correctly. Makeup brushes left without any protective covering can become filled with airborne bacteria, dust and can lead to blemishes, skin irritations and rashes.

SUMMARY

By providing the Protective Makeup Brush Cleansing Kit makeup brushes will have a protective soft flexible silicone covering with cleaning bristles inside that will cleanse the brushes with the aid of the user.

In particular after the cleaning the Protective Makeup Brush Cleansing Kit will prevent the bristles from becoming distorted and brittle by having the protective covers remain on the makeup brushes and then stored on the storage base securely.

The Protective Makeup Brush Cleansing covers keep contaminants out and preserve the makeup brushes resulting in longevity and decreasing blemishes, skin irritations and rashes.

BRIEF DESCRIPTION OF THE DRAWINGS

In the following detailed portion of the present description, the teachings of the present application will be explained in more detail with reference to the example embodiments shown in the drawings, in which.

DETAILED DESCRIPTION

In the following detailed description, the Protective Makeup Brush Cleansing Kit according to the teachings for this application in the form of protective covers and storage base will be described by the embodiments. It should be noted that although only makeup brushes are described the teachings of this application can also be used with other brushes such as barber shaving brushes, barber neck duster brush, Beauty Blenders and other beauty or barber brushes.

Figure 1:
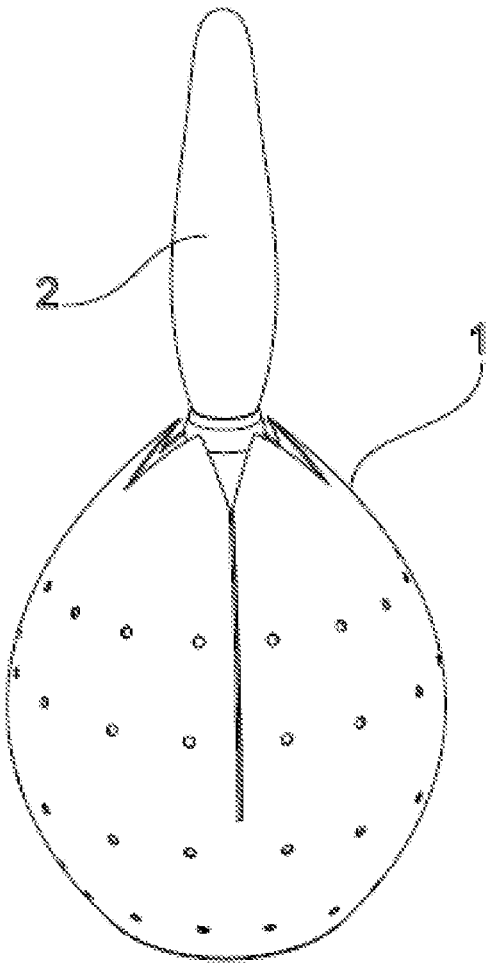
FIG. 1 is an isometric view of the Protective Makeup Brush Cleansing Cover showing what a makeup brush will look like inside the Protective Makeup Brush Cleansing Cover according to a first embodiment.

A first embodiment of the Protective Makeup Brush Cleansing Kit is illustrated in FIG. 1. The Protective Makeup Brush Cleansing cover comprises a combination of soft flexible rubber and an opening for makeup brushes to be inserted. The inserted brush is held securely with six tabs at the center of the makeup brush handle. 1 The Protective Makeup Brush Cleansing cover serves as a cleansing kit when soap and water is added. 1 The Protective Makeup Brush Cleansing cover will also protect makeup brush bristles from becoming warped and distorted. 1 The Protective Makeup Brush Cleansing cover also protects the makeup brush bristles from dust and pollutants. 2 is a makeup brush inserted in the Protective Makeup Brush Cleansing cover. The Protective Makeup Brush Cleansing covers will be made of a soft flexible rubber and will have water release spouts all around for the release of water.

Figure 2:
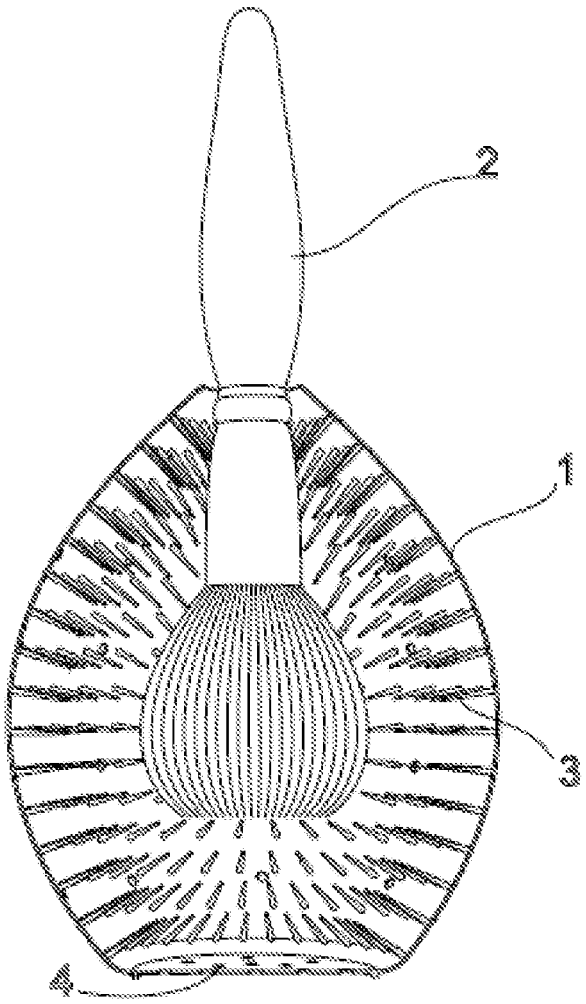
FIG. 2 is an isometric view of the Protective Makeup Brush Cleansing Cover showing the inside of the Protective Makeup Brush Cleansing Cover bristles, the soap and/or water release spouts and what a makeup brush will look like inside the Protective Makeup Brush Cleansing Cover according to a second embodiment.

A second embodiment of the Protective Makeup Brush Cleansing Kit is illustrated in FIG. 2. 1 The Protective Makeup Brush Cleansing cover shows the inside of the Protective Makeup Brush Cleansing cover, including 2 the makeup brush inserted. The Protective Makeup Brush Cleansing covers will have soft rubber 3 bristles throughout the inside to clean the makeup brush bristles. 1 The Protective Makeup Brush cover have 4 water release spouts throughout the 1 Protective Makeup Brush Cleansing covers to allow any excess soap and/or water to be released during the cleansing process.

Figure 3:
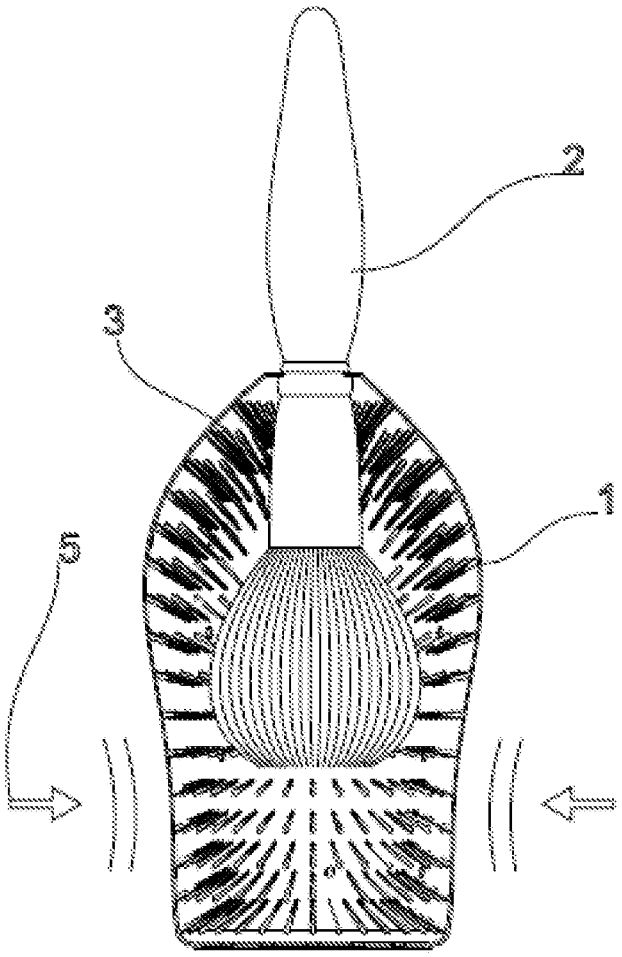
FIG. 3 is an isometric view of the Protective Makeup Brush Cleansing Cover showing the makeup brush being cleaned inside the Protective Makeup Brush Cleansing Cover according to a third embodiment.

A third embodiment of the Protective Makeup Brush Cleansing Kit is illustrated in FIG. 3. 1 The Protective Makeup Brush Cleansing cover shows the inside of the Protective Makeup Brush Cleansing cover cleansing 2 the makeup brush. The purpose of the soft flexible rubber and the 3 bristles inside the Protective Makeup Brush Cleansing covers is to immerse the Protective Makeup Brush Cleansing bristles in to 2 the makeup brush bristles to clean the makeup brush by 5 rubbing the 1 Protective Makeup Brush Cleansing cover bristles into the makeup brush.

Figure 4:
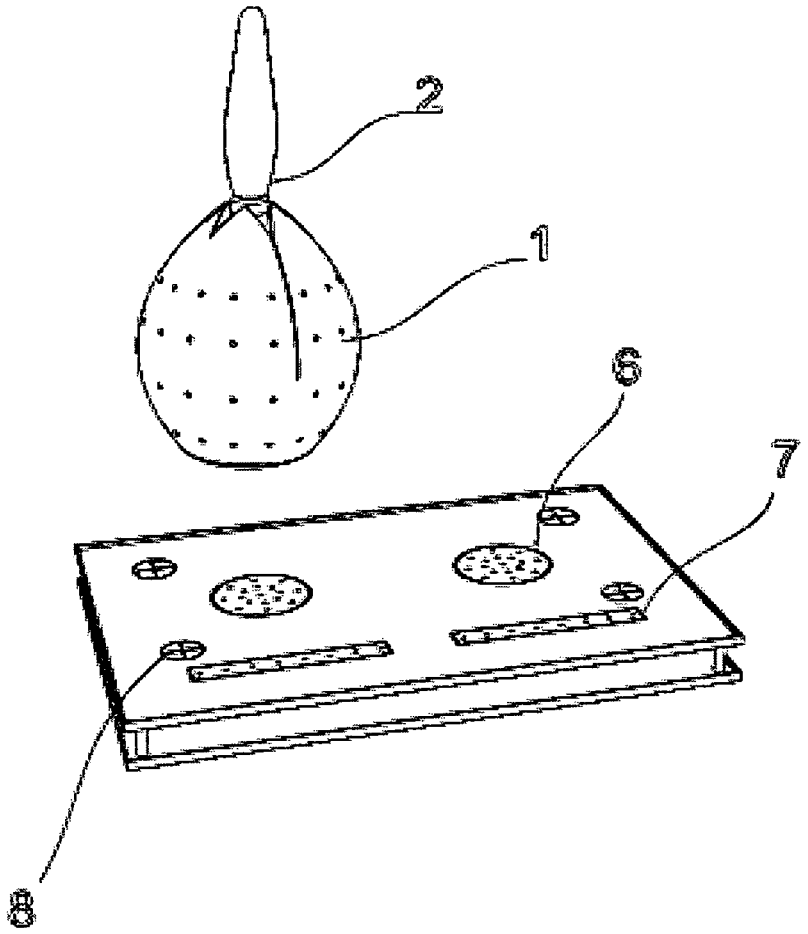
FIG. 4 is an isometric view of the Protective Makeup Brush Cleansing Cover placed on the Storage Base allowing water to be released from the water release spouts according to a fourth embodiment.

A fourth embodiment of the Protective Makeup Brush Cleansing Kit is illustrated in FIG. 4. 1 The Protective Makeup Brush Cleansing cover with an inserted 2 makeup brush placed on the 8 Storage Base securely into 6 the water release spouts slot. The 6 water release spout placement slots allow excess water to be released onto the 9 Drainage Base.

Figure 5:
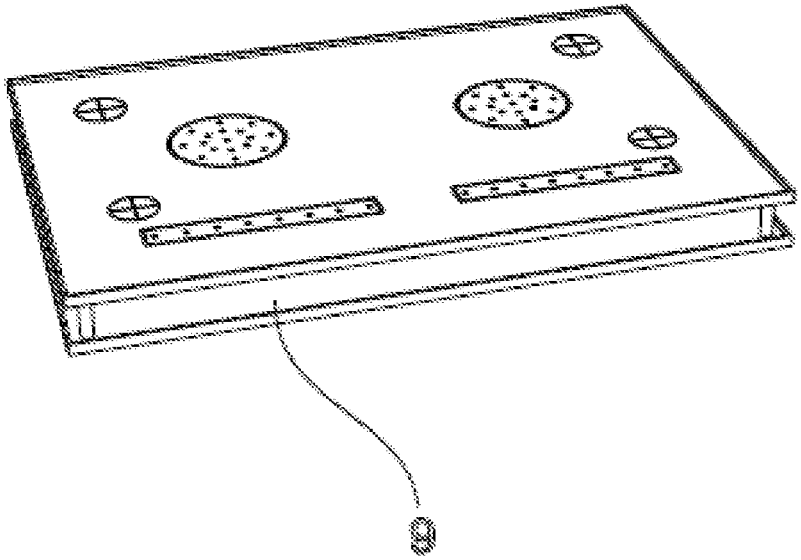
FIG. 5 is an isometric view of the Protective Makeup Brush Cleansing Cover Storage Base Drainage Base according to a fifth embodiment.

A fifth embodiment of the Protective Makeup Brush Cleansing Kit is illustrated in FIG. 5. 9 The Drainage Base will collect any excess water to prevent spillage.

Figure 6:
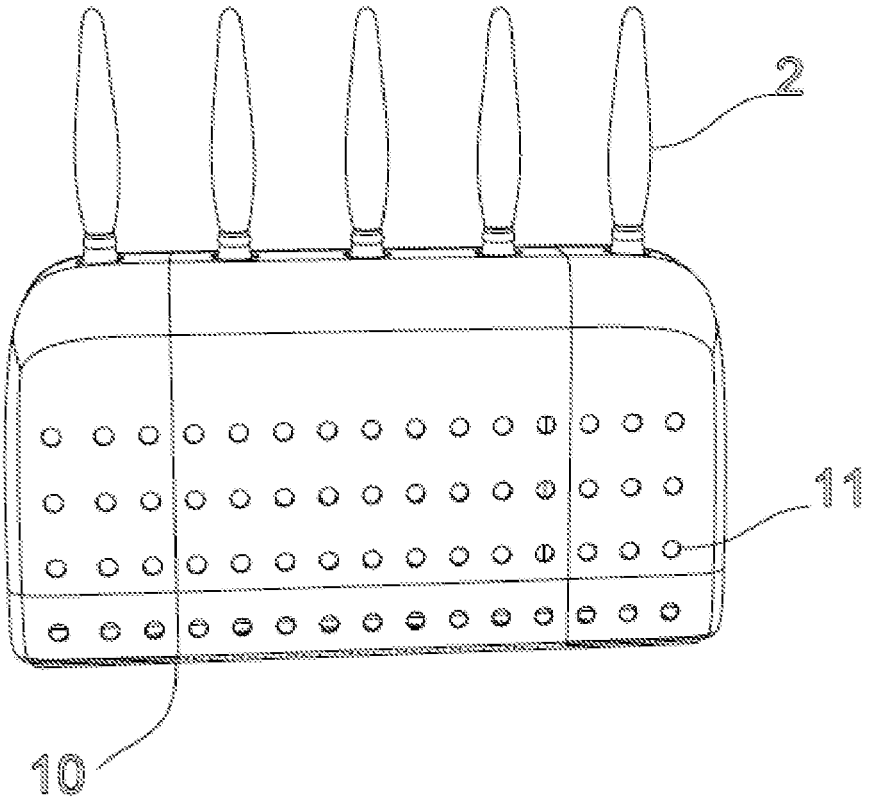
FIG. 6 is an isometric view of the Protective Makeup Brush Cleansing Cover showing multiple small makeup brushes inside the Protective Makeup Brush Cleansing Cover according to a sixth embodiment.

A sixth embodiment of the Protective Makeup Brush Cleansing Kit is illustrated in FIG. 6. 10 The Protective Makeup Brush Cleansing cover comprises a combination of soft flexible rubber and an opening for up to five small 2 makeup brushes to be inserted. 10 The Protective Makeup Brush Cleansing cover serves as a cleansing kit when soap and water is added. 10 The Protective Makeup Brush Cleansing cover will also protect makeup brush bristles from becoming warped and distorted. 10 The Protective Makeup Brush Cleansing cover also protects the makeup brush bristles from dust and pollutants. 2 is a makeup brush inserted in the 10 Protective Makeup Brush Cleansing cover. The Protective Makeup Brush Cleansing covers will be made of a soft flexible rubber and will have 11 water release spouts all around for the release of water.

Figure 7:
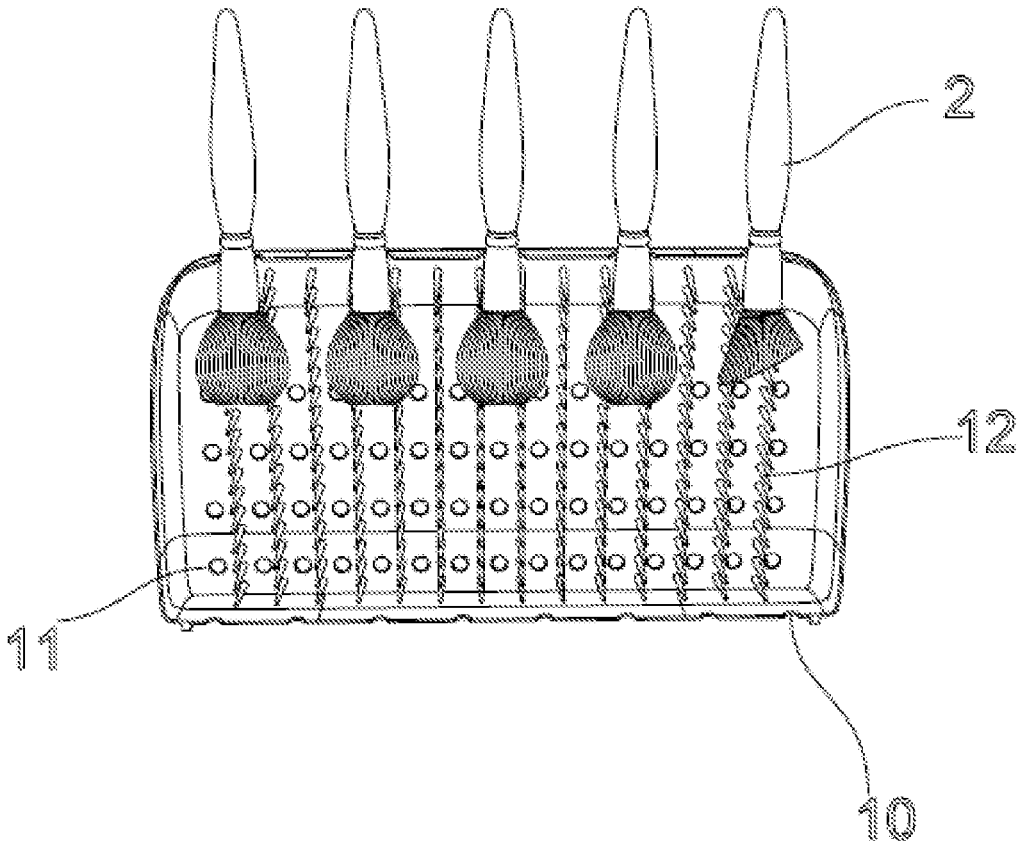
FIG. 7 is an isometric view of the Protective Makeup Brush Cleansing Cover showing the inside of the Protective Makeup Brush Cleansing Cover bristles and multiple makeup brushes inside the Protective Makeup Brush Cleansing Cover according to a seventh embodiment.

A seventh embodiment of the Protective Makeup Brush Cleansing Kit is illustrated in FIG. 7. 10 The Protective Makeup Brush Cleansing cover shows the inside of the Protective Makeup Brush Cleansing cover, including up to five small 2 makeup brushes inserted. The inserted brushes are held securely with six tabs at the center of the makeup brush handles. 10 The Protective Makeup Brush Cleansing covers have soft rubber 3 bristles throughout the inside to clean the brush bristles. 10 The Protective Makeup Brush cover have 4 water release spouts throughout the 10 Protective Makeup Brush Cleansing covers to allow any excess soap and/or water to be released during the cleansing process. The 10 Protective Makeup Brush Cleansing cover for the five small 2 makeup brushes will be placed on the 8 Storage Base securely into 7 the water release spouts slot. The 7 water release spout placement slots allow excess water to be released onto the 9 Drainage Base.

Figure 8:
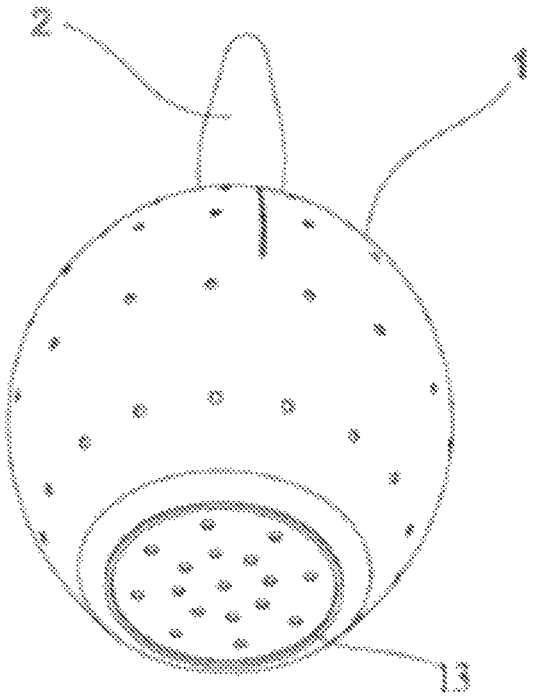
FIG. 8 is an isometric view of the Protective Makeup Brush Cleansing Covers showing the bottom of the Protective Makeup Brush Cleansing Cover placement slots according to an eighth embodiment.

An eighth embodiment of the Protective Makeup Brush Cleansing Kit is illustrated in FIG. 8. 1 The Protective Makeup Brush Cleansing cover shows the bottom 13 placement slot of the 1 Protective Makeup Brush Cleansing cover which allows each cover to be securely fitted into the placement slots on the 8 Storage Base.

The height between the 8 Storage Base and the 9 Drainage Base is one inch. The posts on the 8 Storage Base will snap onto the 9 Drainage Base by way of small grooves to secure them both together.

The Protective Makeup Brush Cleansing Kit is to aid and maintain the makeup brushes bristles to its original form and protect makeup brushes from pollutants. The various aspects of what is described above can be used with various makeup brushes and various makeup brush material combinations. It should be noted that the teaching of the above application is not limited to the use of makeup brushes, but can be equally well applied in barber shaving brushes, barber neck duster brushes and Beauty Blenders.

The teaching of this of the present application has numerous advantages. Different embodiments or implementations may yield one or more of the following advantages. It should be noted that this is not an exhaustive list and there may be other advantages which are not described herein. For example, one advantage is of the teaching of this application is it provides for easy travel. The Protective Makeup Brush Cleansing Kit can be placed in luggage and/or travel bag to ensure the makeup brushes will be secured and protected.

Whilst endeavoring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

The term "comprising" as used in the claims does not exclude other elements or steps. The term "a" or "an" as used in the claims does not exclude a plurality. A unit or other means may fulfill the functions of several units or means recited in the claims.

The invention claimed is:

1. A system for cleaning brushes, comprising in combination:

at least one brush cover including an interior space for receiving a portion of the brush, the cover being formed of a flexible material and including a base portion at a bottom thereof and an opening at a top thereof through which the brush can enter the cover, the cover further including a plurality of water release spouts and a plurality of bristles extending from an inner wall of the cover wherein a cleaning solution can be introduced into the interior space of the cover and the bristles within the cover are configured to cleaning bristles of the brush when received within the cover; and a supporting base on which the base portion of the cover is adapted to be supported, the supporting base comprising:

a storage base including at least one placement slot on which the base portion of the respective cover may be placed and wherein any cleaning solution in the cover may drain; and a drainage base coupled to and disposed beneath the storage base in which cleaning solution which drained from the cover may be collected.

* * * * *